US011168429B2

(12) United States Patent
Kim et al.

(10) Patent No.: US 11,168,429 B2
(45) Date of Patent: Nov. 9, 2021

(54) LAUNDRY APPARATUS

(71) Applicant: LG Electronics Inc., Seoul (KR)

(72) Inventors: Jinwoong Kim, Seoul (KR); Kayeon Kim, Seoul (KR); Sungyong Kim, Seoul (KR); Byeongheon Kwak, Seoul (KR)

(73) Assignee: LG Electronics Inc., Seoul (KR)

( * ) Notice: Subject to any disclaimer, the term of this patent is extended or adjusted under 35 U.S.C. 154(b) by 9 days.

(21) Appl. No.: 16/549,368

(22) Filed: Aug. 23, 2019

(65) Prior Publication Data

US 2020/0063318 A1 Feb. 27, 2020

(51) Int. Cl.

| | |
|---|---|
| ***D06F 37/26*** | (2006.01) |
| ***D06F 21/04*** | (2006.01) |
| ***D06F 37/30*** | (2020.01) |
| ***D06F 37/04*** | (2006.01) |

(52) U.S. Cl.

CPC ..... *D06F 37/269* (2013.01); *D06F 21/04* (2013.01); *D06F 37/04* (2013.01); *D06F 37/30* (2013.01)

(58) Field of Classification Search

None

See application file for complete search history.

(56) References Cited

U.S. PATENT DOCUMENTS

| | | | | |
|---|---|---|---|---|
| 6,050,113 | A | 4/2000 | Skrippek et al. | |
| 2002/0194884 | A1 | 12/2002 | Heyder | |
| 2009/0100879 | A1* | 4/2009 | Kim | D06F 37/262 68/140 |
| 2009/0107187 | A1* | 4/2009 | Kim | D06F 37/269 68/140 |
| 2009/0113942 | A1 | 5/2009 | Ha | |

(Continued)

FOREIGN PATENT DOCUMENTS

| | | | |
|---|---|---|---|
| CN | 103572547 | A | 2/2014 |
| CN | 206502987 | U | 9/2017 |
| CN | 207362526 | U | 5/2018 |

(Continued)

OTHER PUBLICATIONS

European Search Report Application No. 19192760.7-1018 dated Nov. 25, 2019.

(Continued)

*Primary Examiner* — Cristi J Tate-Sims

(74) *Attorney, Agent, or Firm* — Finnegan, Henderson, Farabow, Garrett & Dunner, LLP

(57) ABSTRACT

The present disclosure relates to a laundry apparatus comprising a cabinet, a tub coupled the cabinet, a drum rotatably mounted in the tub, and a drive unit comprising a stator and a rotor. The laundry apparatus further comprises a shaft coupled to the drum and connected to the drive unit via a rear wall of the tub, a bearing rotatably supporting the shaft, and a bearing housing insert-molded in the tub and securing the bearing. The bearing housing comprises a housing body, comprising a shaft insertion hole securing the bearing, formed in a cylinder shape, a first flange formed in a ring shape arranged in an outer area with respect to a radial direction of the housing body, a plurality of first connection ribs connecting an outer circumferential surface of the housing body to the first flange, and a first insertion hole disposed between the first connection ribs.

11 Claims, 8 Drawing Sheets

(56) References Cited

U.S. PATENT DOCUMENTS

2012/0240637 A1* 9/2012 Lim ..... D06F 37/20
68/140

FOREIGN PATENT DOCUMENTS

| | | | |
|---|---|---|---|
| DE | 102006054558 | A1 | 8/2007 |
| EP | 1528136 | B1 | 5/2005 |
| EP | 2060669 | A1 | 5/2009 |
| JP | 2010-012088 | A | 1/2010 |
| KR | 10-0610666 | B1 | 8/2006 |
| KR | 10-0962073 | B1 | 6/2010 |
| KR | 10-2011-0025563 | A | 3/2011 |
| WO | WO 2008/010674 | A2 | 1/2008 |
| WO | WO 2010/077089 | A2 | 7/2010 |

OTHER PUBLICATIONS

International Search Report PCT/KR2019/010473 dated Dec. 10, 2019.
Chinese Office Action in Application No. CN 201910778327.4, dated Apr. 6, 2021 (7 pages).

* cited by examiner

- Related Art-

LAUNDRY APPARATUS

CROSS-REFERENCE TO RELATED APPLICATIONS

This application claims the benefit of priority under 35 U.S.C. § 119 to Korean Patent Application No. 10-2018-0098620 filed on Aug. 23, 2018, the disclosure of which is hereby incorporated by reference in its entirety.

BACKGROUND

Technical Field

The present disclosure relates to a laundry apparatus.

Discussion of the Related Art

A laundry apparatus includes a tub for holding water, a bearing housing coupled to a rear surface of the tub, and a drum shaft configured to rotatably penetrate the bearing housing. A laundry apparatus of the related art as illustrated in FIG. 1 disposes the bearing housing on the rear surface of the tub by processing an insert molding. The insert molding may reinforce durability and prevent a problem related to a bearing housing deformation and a separation between the bearing housing and the tub, wherein the bearing housing deformation is caused by tension from a rotation of the drum shaft. Also, the insert molding may enhance space efficiency inside a cabinet comprising the tub, the drum shaft, and the bearing housing.

The laundry apparatus of the related art as further illustrated in FIG. 1 includes a plurality of recessions formed in the bearing housing to reinforce a sealing between the bearing housing and the tub. The plurality of recessions may comprise a concave area and a convex area. The laundry apparatus of the related art further includes a plurality of uneven areas formed in an inner surface of the tub facing the plurality of recessions to secure the strength of the tub against a high speed spinning of the drum shaft.

Therefore, the laundry apparatus of the related art has problems that water and vapors frequently contact with an inner wall of the tub and the uneven areas might cause the water and vapors to remain in the inner wall. The remaining water and vapors may congregate molds or foreign substances that would lead to serious sanitation problems including a bad smell, a propagation of germs, etc. Moreover, air inside the tub may flow together with the water during the rotation of the drum shaft causing the uneven areas to make aerodynamic noises. Further, the laundry apparatus of the related art has problems that the bearing housing has a weak rigidity and is subject to a torque generated by the rotation of the drum shaft and the plurality of the recessions formed in the bearing housing might enlarge the width of the bearing housing to deteriorate the efficient use of the space inside the cabinet.

SUMMARY

Accordingly, the present disclosure provides a laundry apparatus that substantially obviates one or more problems discussed above due to limitations and disadvantages of the related art.

An object of the present disclosure is to provide a laundry apparatus, which may reduce sanitation problems by providing a smooth rear inner surface with a tub.

Still another object of the present disclosure is to provide a laundry apparatus, which may reduce a noise generated by a shape of a rear inner surface formed in a tub during a rotation of a drum shaft.

Further still another object of the present disclosure is to provide a laundry apparatus, which may enhance a strength of a bearing housing disposed on a rear wall of a tub by processing an insert molding.

Further still another object of the present disclosure is to provide a laundry apparatus, which may improve a space usage inside a tub by improving a shape of a bearing housing.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these objects and other advantages and in accordance with the purpose of the disclosure, as embodied and broadly described herein, a laundry apparatus according to the present disclosure comprises a cabinet; a tub disposed in the cabinet and configured to hold water; a drum rotatably mounted in the tub and configured to hold laundry; a drive unit comprising a stator configured to form an electromagnetic field and a rotor rotatable by the electromagnetic field; a shaft fixed to the drum and connected to the drive unit via a rear wall of the tub; a bearing rotatably supporting the shaft; and a bearing housing insert-molded in the tub and configured to secure the bearing, wherein the bearing housing comprises a housing body in a cylinder shape and comprising a shaft insertion hole configured to secure the bearing; a first flange in a ring shape arranged in an outer area with respect to a radial direction of the housing body; a plurality of first connection ribs connecting an outer circumferential surface of the housing body to the first flange; and a first insertion hole disposed between the first connection ribs.

A longitudinal axis of each of the plurality of first connection ribs may be perpendicular to a circumferential surface of the housing body.

The laundry apparatus may further comprise a stator securing portion disposed between the first connection ribs, wherein the first insertion hole and the stator securing portion may be alternately disposed between the first connection ribs along a circumference of the housing body.

The bearing housing may comprise a second flange in a ring shape and arranged in an outer area with respect to a radial direction of the first flange; a plurality of second connection ribs connecting an outer circumferential surface of the first flange to the second flange; and a plurality of second insertion holes disposed between the second connection ribs, and wherein a longitudinal axis of each of the plurality of second connection ribs is perpendicular to the circumferential surface of the housing body.

One of the plurality of first connection ribs and one of the plurality of second connection ribs may be disposed on a line perpendicular to the circumferential surface of the housing body.

The back-and-forth width of each of the plurality of first connection ribs may be narrower toward the first flange as the first connection rib extends from the housing body towards the first flange, and a back-and-forth width of each of the plurality of second connection ribs may be narrower toward the second flange as the second connection rib extends from the first flange towards the second flange, and the back-and-forth width of the first connection rib may be larger than the back-and-forth width of the second connection rib.

the outer circumferential surface of the first flange forms one side of the second insertion hole, and a radial-direction center of the housing body may form a sector.

A diameter of the bearing housing may be 60~80% of a diameter of the rear wall of the tub.

The first flange and the second flange may be located behind a front end of the housing body.

Each of the plurality of second connection ribs may be longer than each of the plurality of first connection ribs.

Each of the second connection ribs may be equal to or shorter than each of the plurality of first connection ribs.

The bearing housing may comprise a third flange in ring shape arranged in an outer area with respect to a radial direction of the second flange; a plurality of third connection ribs connecting an outer circumferential surface of the second flange to the third flange; a plurality of third insertion holes disposed between the third connection ribs, wherein a longitudinal axis of each of the plurality of third connection ribs may be perpendicular to the circumferential surface of the housing body.

A stator coupling portion may be disposed in the rear wall of the tub and configured to couple to the stator, and wherein the rotor may comprise a rotor housing fixed to the shaft; and a permanent magnet fixed to the rotor housing and disposed in an outer area with respect to a radial direction of the stator.

According to embodiments of the present disclosure, the laundry apparatus has following effects.

First, the laundry apparatus according to the present disclosure enhances sanitation by forming a smooth and flat rear wall of a tub.

Furthermore, the laundry apparatus according to the present disclosure reduces an aerodynamic noise during the rotation of the drum.

Still further, the laundry apparatus according to the present disclosure improves the durability of the bearing housing.

Still further, the laundry apparatus according to the present disclosure has a better use of a space.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION

Reference will now be made in detail to the preferred embodiments of the present disclosure, examples of which are illustrated in the accompanying drawings. Meanwhile, elements or control method of apparatuses which will be described below are only intended to describe the embodiments of the present disclosure and are not intended to restrict the scope of the present disclosure. Wherever possible, the same reference numbers will be used throughout the drawings to refer to the same or like parts.

Figure 1:
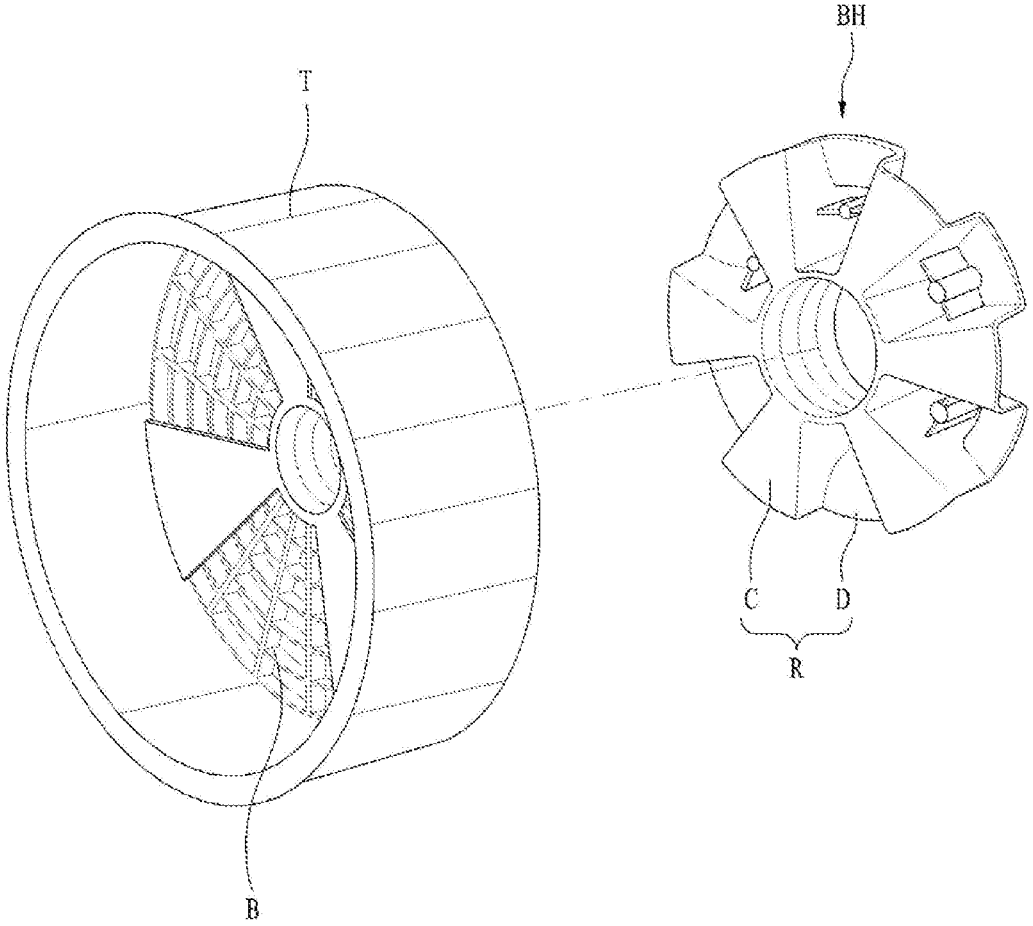
FIG. 1 illustrates a tub and a bearing housing provided in a laundry apparatus of the related art.
Figure 2:
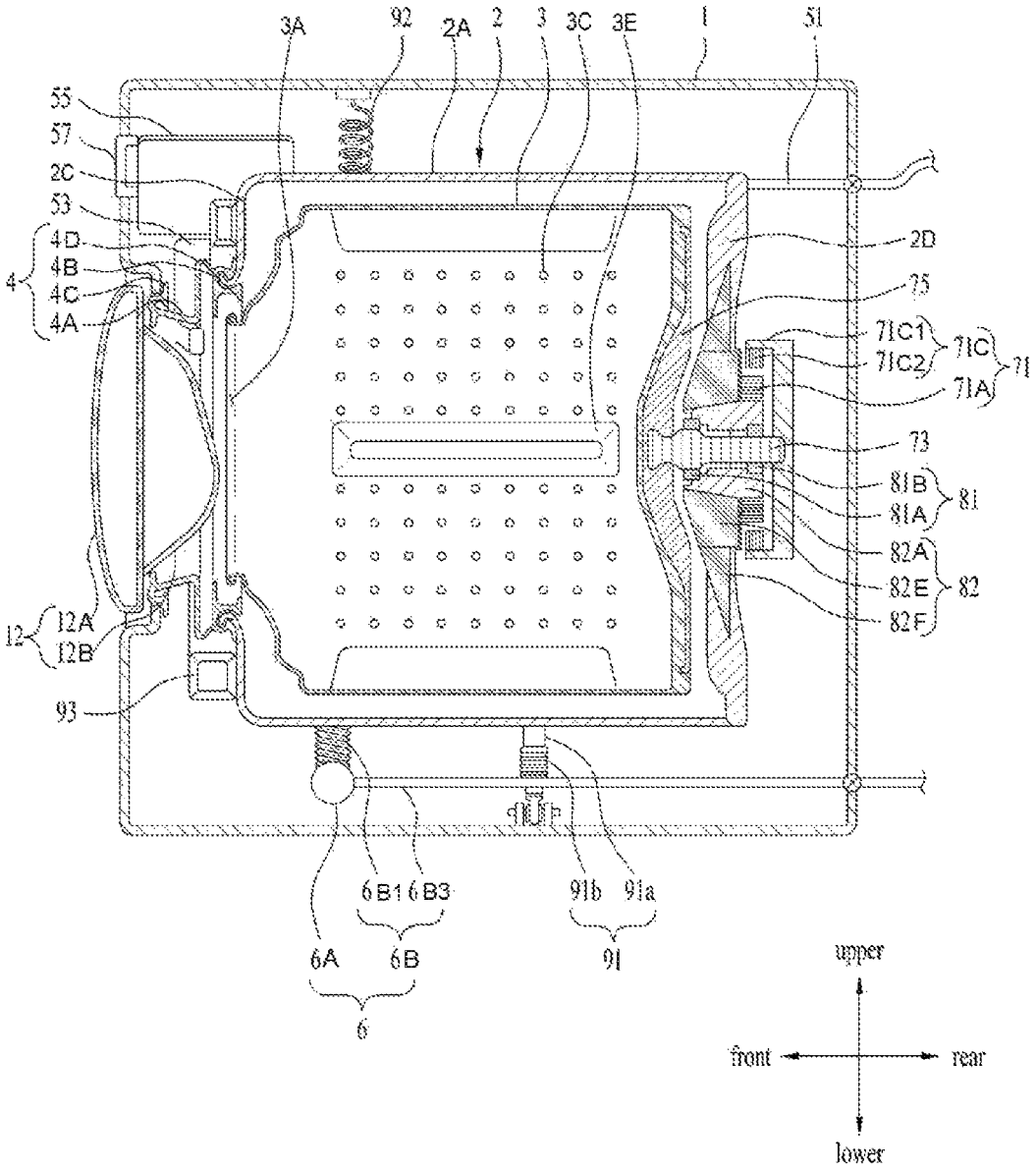
FIG. 2 illustrates a sectional view of an inner structure of a cabinet provided in a laundry apparatus according to the present disclosure.

FIG. 2 illustrates a sectional view of an inner structure of a cabinet 1 in a laundry apparatus according to the present disclosure.

The laundry apparatus may include a cabinet 1 defining an exterior design, a tub 2 disposed in the cabinet 1, and a drum 3 rotatably mounted in the tub 2 and configured to accommodate laundry.

The cabinet 1 may include an opening formed in a front side of the cabinet 1 to introduce the laundry and a door 12 may be rotatably coupled to the cabinet 1 to open and close the opening.

The door 12 may include a circular door frame 12A and a transparent window 12B disposed in a center of the door frame 12A.

As used herein, a direction toward the door 12 with respect to the center of the cabinet 1 may be defined as a front side. An opposite direction from the door 12 toward the center of the cabinet 1 may be defined as a rear side. A right side and a left side may be naturally defined by the front and rear sides.

The tub 2 may include a tub body 2A provided as a cylinder shape with a longitudinal axis disposed in parallel or keeping 0~30 degrees with a bottom surface of the cabinet 1, a tub front wall 2C disposed in a front side of the tub body 2A and configured to communicate with the opening, and a tub rear wall 2D disposed in a rear side of the tub body 2A.

The tub 2 may be fixed to the bottom surface of the cabinet 1 by a lower supporter 91 having a support bar 91*a* and a damper 91*b* connected to the support bar 91*a*. Accordingly, the lower supporter 91 may damp the vibration generated in the tub 2 by the rotation of the drum 3.

In addition, an elastic supporter 92 provided in a top surface of the cabinet 1 may be connected to a top surface of the tub 2. Accordingly, the elastic supporter 92 may damp the vibration generated in the tub 2 and transferred to the cabinet 1.

The drum 3 may be provided in a cylinder shape having a longitudinal axis arranged in parallel or keeping 0~30 degrees with the bottom surface of the cabinet 1 to accommodate the laundry. The drum 3 may include a drum opening 3A disposed in a front side to communicate with a tub opening.

Accordingly, a user may load laundry into the drum 3 through the opening, the tub opening and the drum opening 3A or unload the laundry from the inside of the drum 3.

Also, the drum 3 may further include a lifter 3E provided in an inner circumferential surface of the drum 3 to agitate the laundry when the drum rotates and a plurality of through-holes 3C penetrating an outer circumferential surface of the drum 3.

The laundry apparatus may further include a water supply hose 51 configured to receive water from an external water supply source, a detergent box 55 fixed to the cabinet 1 and configured to supply a washing detergent to the tub 2 in communication with the water supply hose 51, and a detergent box drawer 57 detachable from the detergent box 55 to be retractable from the front side of the cabinet 1.

The laundry apparatus may further include a water supply hose 53 that is extendible and facilitating communication between the detergent box 55 and the tub 2. The washing detergent supplied to the detergent box 55 may be mixed with the water supplied along the water supply hose 51 and then discharged into the tub 2 through the water supply pipe 53.

A gasket 4 may be disposed between the opening of the cabinet 1 and the tub opening. The gasket 4 may prevent a water leakage from the tub 2 towards the cabinet 1 and further prevent a transmission of vibration from the tub 2 to the cabinet 1.

The gasket 4 may include a cabinet fixing portion 4C connected to an area where the opening of the cabinet 1 is formed, a tub fixing portion 4B connected to an area where the tub opening is formed, and a circular gasket body 4A provided to connect the cabinet fixing portion 4C and the tub fixing portion 4B.

The gasket 4 may be made of a flexible material (e.g., rubber) to damp the vibration transferred from the tub 2 to the cabinet 1. The vibration may be effectively damped by a vibration isolating member 4D, which is curved from a circumferential surface of the gasket body 4A along a perpendicular direction with respect to the circumferential surface.

A weight balancer 93 may be disposed in a front surface of the tub 2 and outside the gasket 4 and configured to damp the vibration generated in the drum 3.

In some embodiments, the laundry apparatus may include a water discharge pipe 6B configured to provide a water discharge path for the water held in the tub 2, and a water discharge pump 6A comprising a water discharge motor and a water discharge impeller for generating a pressure different from the water discharge pipe 6B. The water discharge pump 6A may discharge the water via the water discharge pipe 6B.

The water discharge pipe 6B may include a first water discharge pipe 6B1 connecting the bottom surface of the tub 2 and the water discharge pump 6A, and a second water discharge pipe 6B3 connecting one end of the second water discharge pipe 6B3 and the water discharge pump 6A and forming a path for the water to flow outside the cabinet 1.

A drive unit 71, placed behind the tub 2, may be configured to rotate the drum 3. The drive unit 71 may include a stator 71A fixed to a rear surface of the tub 2 and a rotor 71C rotatable by the electromagnetic action associated with the stator 71A.

Exemplary methods for rotating the drum 3 by the drive unit 71 may include a method of using a belt to transfer a power to a shaft 73 and another method is associated with using a rotor 71C directly connected to the shaft 73. As used herein, the latter method is described further as an example.

The laundry apparatus, in some embodiments, may include a shaft 73 penetrating the tub rear wall 24 and connecting the drum to the rotor 713, and an arm 75 disposed on a rear surface of the drum 3 and configured to transfer a rotational force of the shaft 73 to the drum 3. The arm 75 may be fixed to the drum 3 and extended in a radial direction with respect to a rotation center of the drum rear wall.

The stator 71A may be secured to a stator coupling portion 241 placed in the tub rear wall 2D. The rotor 71C may comprise a permanent magnet 71C2 spaced a predetermined distance apart from the stator 71A in a perpendicular direction with respect to the shaft 73 and a rotor housing 71C2 connecting the permanent magnet 71C2 and the shaft 75.

The laundry apparatus, in some embodiments, may include a bearing 81 supporting the shaft 73 and a bearing housing 82 affixed to the tub 2 by processing an insert molding. The bearing housing 82 may secure the bearing 81 to the tub. The bearing housing 81 may be disposed between the shaft 73 and the bearing housing 82. The bearing housing 81 may include a first bearing 81A fixed to a front area of the bearing housing 82 and a second bearing 81B fixed to a rear area of the bearing housing 82.

Hereinafter, referring to FIGS. 3 and 4, the bearing housing 82 according to one embodiment will be described in detail.

The bearing housing 82 may include a housing body 82A, a first flange 82B, and a first connection rib 82C. The housing body 82A may be in a cylinder shape and comprise a shaft insertion hole 82A1. The first flange 82B may be in a ring shape and disposed on an outer area with respect to a radial direction of the housing body 82A, while being spaced a preset distance apart from the housing body 82A. The first connection rib 82C may connect the housing body 82A to the first flange 82B.

A first bearing coupling portion 82A2 may be disposed in a front area of the shaft insertion hole 82A1 to couple the first bearing 81A thereto and a second bearing coupling portion 82A3 provided in a rear area to couple the second bearing 81B thereto.

A plurality of first connection ribs 82C may be provided and a longitudinal axis of each first connection rib 82C may be disposed along a perpendicular line with respect to a circumferential surface of the housing body 82A.

In other words, the first connection rib 82C may be extended from a circumferential surface of the housing body 82A in a radial direction and connected to the first flange 82B.

Also, a first insertion hole 82D may be formed between the first connection ribs 82C. A material forming the tub 2 (e.g., synthetic resin) may fill the first insertion hole 82D as the bearing housing 82 is inserted in the tub 2. Accordingly, the sealing between the bearing housing 82 and the tub rear wall 2D may be enhanced.

A stator securing portion 82E may be disposed between the first connection ribs 82C to secure the stator 71A to the tub rear wall 2D.

The stator securing portion 82E may be backwardly projected with respect to the first connection ribs 82C. For that, an inner surface of the stator securing portion 82E may be backwardly recessed.

The material forming the tub 2 (e.g., synthetic resin) may be filled in a space formed after the inner surface of the stator securing portion 82E is backwardly recessed.

A securing hole 82E1 may be formed in the stator securing portion 82E and a bolt may be secured to the stator securing portion 82E to fix the stator 71A. A securing portion inner insertion hole 82E2 may be disposed in an inner area of the securing hole 82E1 and a securing portion outer insertion hole 82E3 may be disposed in an outer area with respect to a radial direction of the housing body 82A.

The securing portion inner and outer insertion holes 82E2 and 82E3 may be also filled with the material forming the tub 2. Accordingly, the sealing between the bearing housing 82 and the tub rear wall 2D may be improved and the consumption of the material forming the bearing housing 82 may be reduced.

The first insertion hole 82D and the stator securing portion 82E may be arranged along a circumference of the housing body 82A. At this time, the first insertion hole 82D and the stator securing portion 82E may be alternately provided. Any arrangements may be applicable only if the first insertion hole 82D and the stator securing portions 82E are arranged in opposite areas with respect to an axis perpendicular to the ground while passing the center of the bearing housing 82, by the same number.

Moreover, the bearing housing 82 may further include a second flange 82F and a plurality of second connection ribs 82G. The second flange 82F may comprise a ring shape and disposed in an outer area with respect to a radial direction of the first flange 822 and spaced a preset distance apart from the first flange 822. The plurality of second connection ribs 82G may connect an outer circumferential surface of the first flange 82B to the second flange 82F.

Similarly, a second insertion hole 82H may be disposed between the second connection ribs 82G. The material forming the tub 2 may be fill the second insertion hole 82H as the bearing housing 82 is inserted in the tub 2.

The second insertion hole 82H may be disposed between two legs of the second connection ribs 82G, different from the first insertion hole 82D.

A longitudinal axis of each second connection rib 82G may be disposed on a perpendicular line of the housing body 82A. In other words, the second connection ribs 82G may be extended from the first flange 82B in a radial direction and then connected to the second flange 82F.

At this time, the first connection ribs 82C and the second connection ribs 82G may be disposed on the same line along the perpendicular line of the housing body 82A.

Accordingly, a line connecting some point of an arc of the first flange 82B forming one of the second insertion holes 82H and a radial center of the housing body may form a fan shape.

In other words, the housing body 82A, the first connection ribs 82C, the second connection ribs 82G, and the second flange 82F may be connected to form a spoke shape.

As the bearing housing 82, including the plurality of the flanges and connection ribs, is inserted in the tub rear wall 2D, the strength of the tub rear wall may be secured even without auxiliary uneven structure formed in the tub rear wall 2D.

In some embodiments, the first flange 82B and the second flange 82F may be located behind a front end of the housing body 82A. The first connection ribs 82C may be located in a line connecting the front end of the housing body 82A and the first flange 82B at the shortest distance.

As stress distribution will be described below, the stress per unit volume, that is applied to the bearing housing 82 along the rotation of the shaft 73 is the largest near the housing body 82A and becomes smaller towards the outer area in a radial direction of the shaft 73.

Accordingly, the back-and-forth width of the first connection rib becomes narrower as the first connection rib is extended from the housing body 82A towards the first flange 82B. The back-and-forth width of the second connection rib 82B becomes narrower as the second connection rib 82B is extended from the housing body 82A towards the second flange 82F. The width of the first connection rib 82C may be wider than that of the second connection rib 82F.

The area of the connection rib having a high stress per unit volume may form thick and the area having a low stress per unit volume may form thin, such that the material forming the bearing housing 82 can be reduced while the use of the space inside the tub and the space inside the tub 2 can be enhanced effectively.

The length L of the second connection rib 82G may be larger than the length K of the first connection rib 82C. The sealing force between the bearing housing 82 and the tub 2 may be enhanced by enlarging a radius of the tub rear wall 2D occupied by the bearing housing 82.

Figure 5:
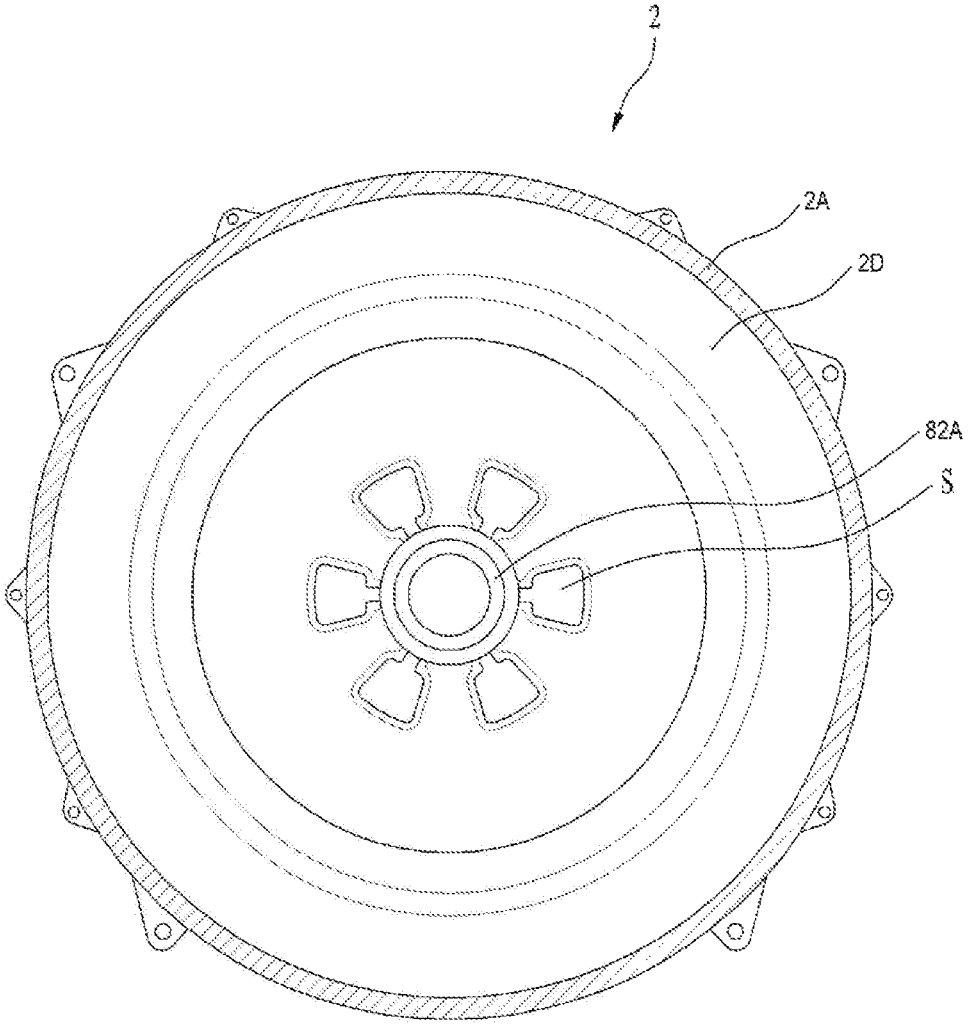
FIG. 5 illustrates a front view of an inner wall of a tub in which the bearing housing of FIG. 3 is insert-molded.
Figure 6:
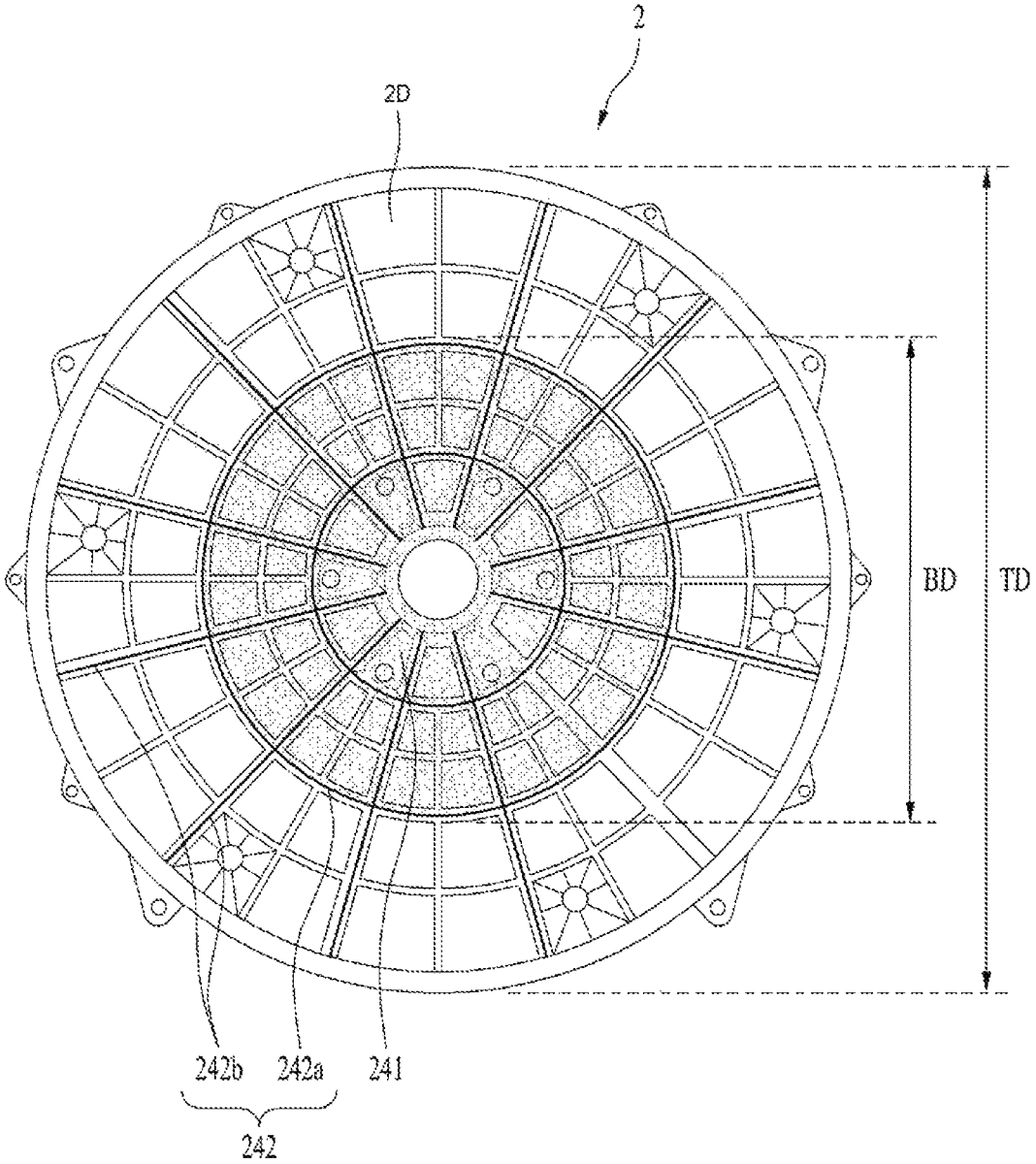
FIG. 6 illustrates a rear view of a rear surface of the tub of FIG. 5 in which the bearing housing of FIG. 3 is insert-molded.

FIGS. 5 and 6 show one illustrative embodiment of a bearing housing 82, consistent with the present disclosure. FIG. 5 illustrates a front view of an inner wall of the tub 2 in which the bearing housing 82 is insert-molded, and FIG. 6 illustrates a rear view of the same. As shown in FIG. 5, in order to reduce the projected area of the tub rear wall 2D, compared against the laundry apparatus of the related art, a bearing housing 82 is insert-molded to an inner area of the tub rear wall 2D, wherein the inner area of the tub rear wall 2D may comprise a smooth surface, except an area S corresponding to the stator securing portion. The reduced area of the tub rear wall 2D may improve a sanitation of the tub 2 and reduce an aerodynamic noise from the rotation of the drum 3.

As shown in FIG. 6, a diameter BD of the bearing housing 82 may be 60~80% of a diameter TD of the tub rear wall 2D.

Compared with the conventional laundry apparatus, a ratio of the diameter of the bearing housing to the diameter of the tub rear wall 2D may be relatively larger. While the material of the bearing housing 82 is saved, the durability against the rotation stress may be enhanced effectively.

The stator coupling portion 241 disposed in the rear surface of the stator securing portion 82E may be projected from the tub rear wall 2D and a projection 242 may increase the strength of the tub 2.

The projection 242 may include a first projection 242*a* projected from a rear surface of the second flange 82F in a circular shape and a second projection radially projected from rear surfaces of the first and second connection ribs 82C and 82G.

Figure 7:
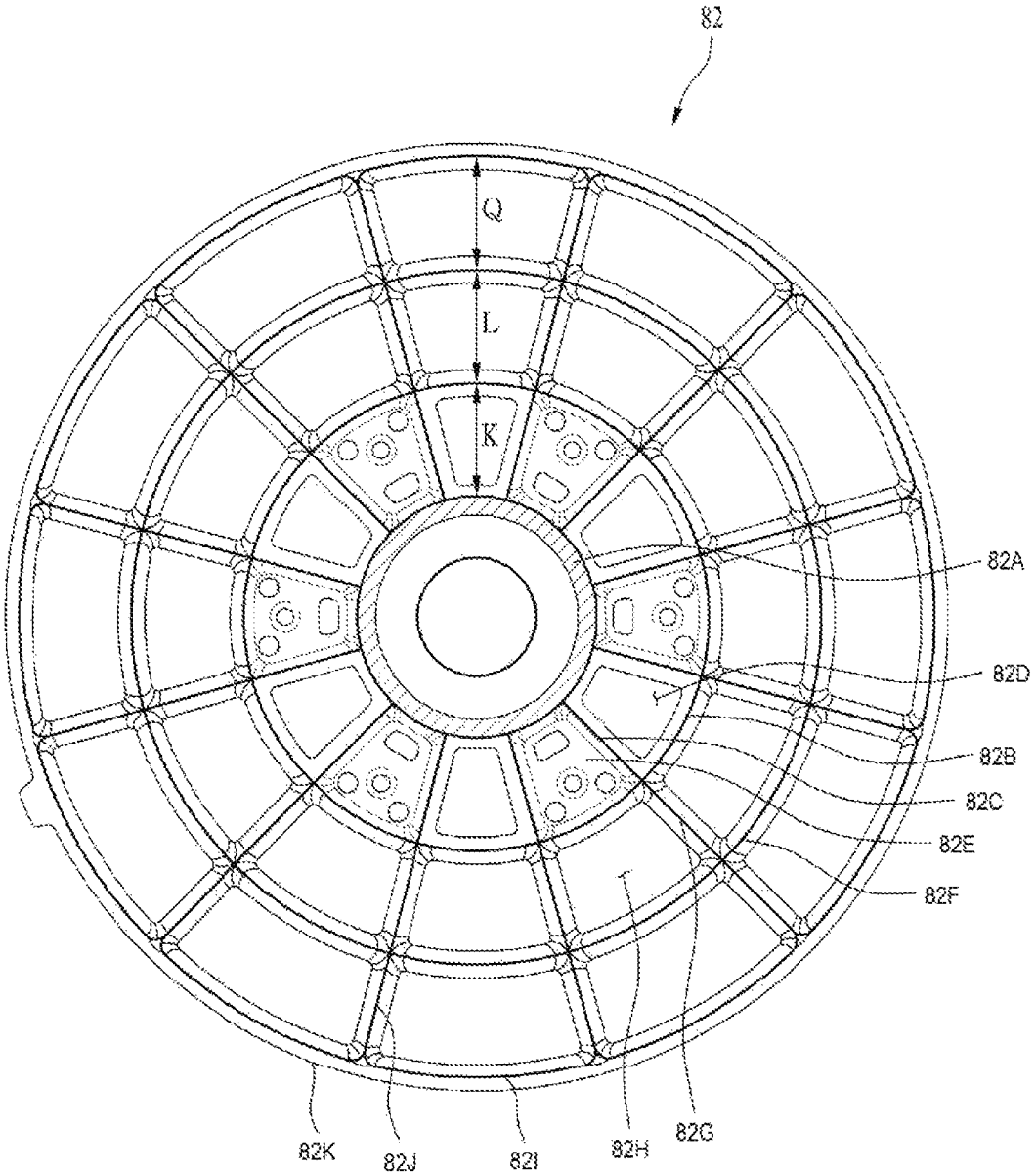
FIG. 7 illustrates a rear view of a bearing housing according to another embodiment of the present disclosure.

In FIG. 7, another embodiment of the bearing housing 82 provided in the laundry apparatus according to the present disclosure will be described, focused on a different feature from the above-noted embodiment.

This embodiment of the bearing housing 82 may further include a third flange disposed in an outer area with respect to a radial direction of the second flange in a ring shape, spaced apart a preset distance apart from the second flange 82F and a plurality of third connection ribs provided to connect the second flange 82F with the third flange 821.

A third insertion hole 82K may be disposed between the third connection ribs 82J and a material forming the tub 2 may filled in the third insertion hole 82K as the bearing housing 82 is inserted in the tub 2. A plurality of third insertion holes may be disposed between two of the third connection ribs, respectively.

A longitudinal axis of each third connection rib 82J may be provided on a perpendicular line of the housing body. In other words, the third connection ribs 82J may be radially extended from the second flange 82F to be connected to the third flange 821.

At this time, the first connection rib 82C, the second connection rib 82G and the third connection rib 82J may be disposed on the same line along the perpendicular line of the housing body.

Accordingly, a line from some area of an arc of the third flange 821 forming one of the third insertion holes 82K to a center of a radial direction of the housing body 82A may form a sector.

In some embodiments, the length K of the first connection rib 82C, the length K of the second connection ribs 82G, and the length Q of the third connection rib 82J may be equal.

Figure 3:
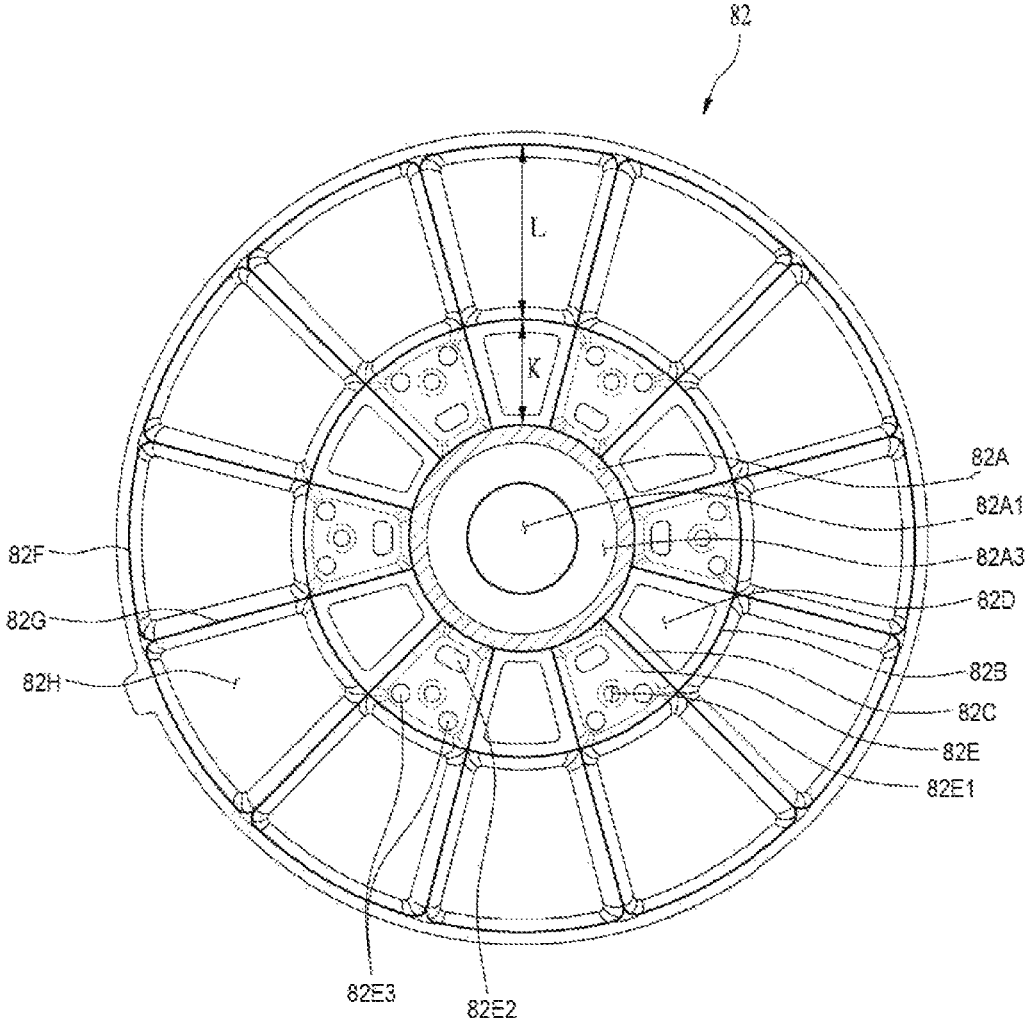
FIG. 3 illustrates a rear view of a bearing housing according to the present disclosure.
Figure 4:
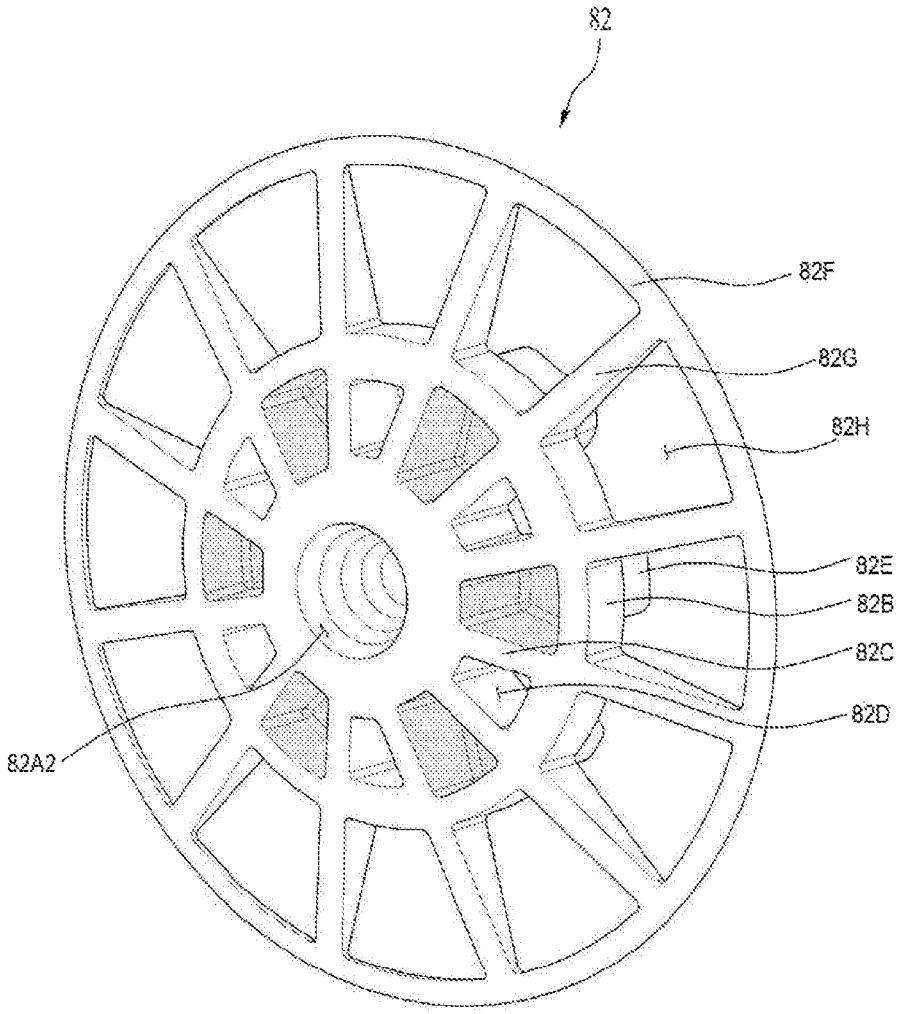
FIG. 4 illustrates a front view of the bearing housing of FIG. 3 according to the present disclosure.

This embodiment may be applied when the tub rear wall 2D of the embodiment shown in FIG. 3 is expanded.

Figure 8:
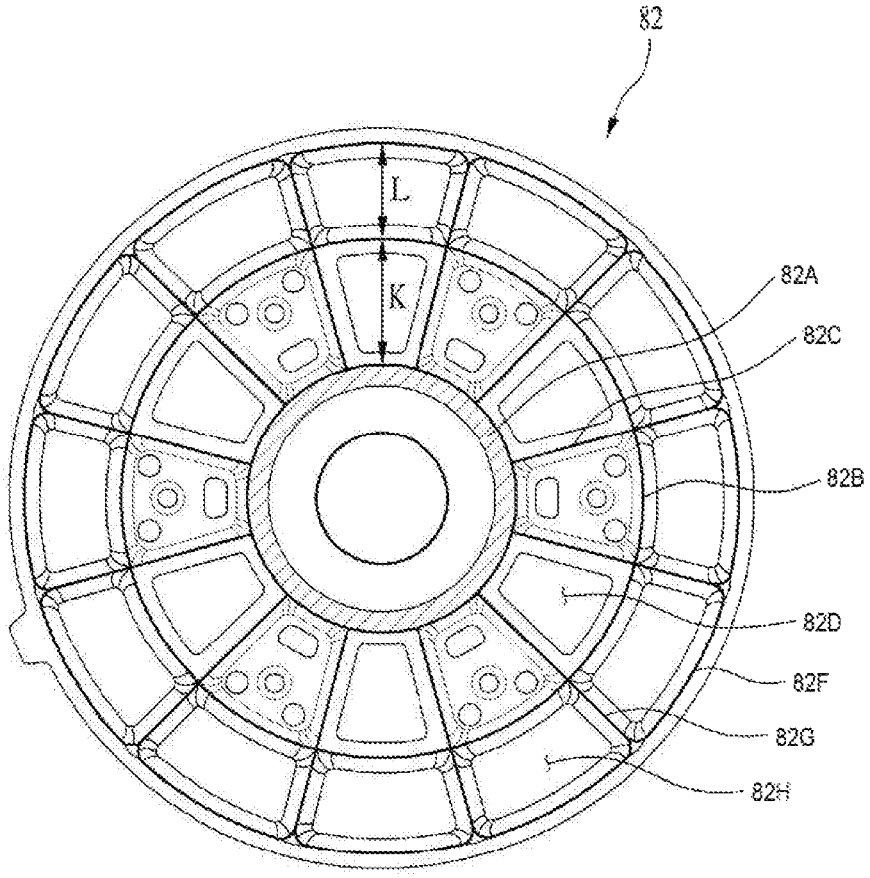
FIG. 8 illustrates a rear view of a bearing housing according to a further embodiment of the present disclosure.

FIG. 8 illustrates a rear view of the bearing housing 82 described in FIG. 7. This embodiment may be applied when the tub rear wall 2D of the embodiment shown in FIG. 3 is contracted.

Different from the above-noted embodiments, the length L of the second connection rib 82G may be shorter than the length K of the first connection rib 82C in this embodiment.

Accordingly, only the length of the second connection rib 82G is reduced in the bearing housing 82 such that the conventional manufacturing equipment may be used in manufacturing a different-sized laundry apparatus.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims.

Therefore, all changes and modifications that fall within the metes and bounds of the claims, or equivalents of such metes and bounds, are therefore intended to be embraced by the appended claims.

What is claimed is:

1. A laundry apparatus comprising:

a cabinet;

a tub disposed in the cabinet and configured to hold water;

a drum rotatably mounted in the tub and configured to hold laundry;

a drive unit comprising a stator configured to form an electromagnetic field and a rotor rotatable by the electromagnetic field;

a shaft fixed to the drum and connected to the drive unit via a rear wall of the tub;

a bearing rotatably supporting the shaft; and a bearing housing insert-molded in the tub and configured to secure the bearing to the tub, wherein the bearing housing comprises, a housing body in a cylinder shape and comprising a shaft insertion hole configured to secure the bearing;

a first flange in a ring shape arranged in an outer area with respect to a radial direction of the housing body;

a second flange in a ring shape arranged in an outer area with respect to a radial direction of the first flange;

a plurality of first connection ribs connecting an outer circumferential surface of the housing body to the first flange;

a plurality of second connection ribs extending from the first flange in a radial direction and connecting to the second flange, wherein a longitudinal axis of each second connection rib is provided on a perpendicular line of the housing body;

a plurality of first insertion holes disposed between the first connection ribs; and a plurality of second insertion holes disposed between the second connection ribs, wherein a width of each of the plurality of first connection ribs uniformly decreases toward the first flange as the first connection rib extends from the housing body towards the first flange, wherein a width of each of the plurality of second connection ribs is narrower toward the second flange as the second connection rib extends from the first flange towards the second flange, and wherein the width of the first connection rib is larger than the width of the second connection rib.

2. The laundry apparatus of claim 1, wherein a longitudinal axis of each of the plurality of first connection ribs is perpendicular to a circumferential surface of the housing body.

3. The laundry apparatus of claim 2, further comprising:

a stator securing portion disposed between the first connection ribs, wherein the first insertion hole and the stator securing portion are alternately disposed between the first connection ribs along a circumference of the housing body.

4. The laundry apparatus of claim 1, wherein one of the plurality of first connection ribs and one of the plurality of second connection ribs are disposed on a line perpendicular to the circumferential surface of the housing body.

5. The laundry apparatus of claim 1, wherein the outer circumferential surface of the first flange forms one side of the second insertion hole, and a radial-direction center of the housing body forms a sector.

6. The laundry apparatus of claim 1, wherein a diameter of the bearing housing is 60~80% of a diameter of the rear wall of the tub.

7. The laundry apparatus of claim 1, wherein the first flange and the second flange are located behind a front end of the housing body.

8. The laundry apparatus of claim 1, wherein each of the plurality of second connection ribs is longer than each of the plurality of first connection ribs.

9. The laundry apparatus of claim 1, wherein each of the plurality of second connection ribs is equal to or shorter than each of the plurality of first connection ribs.

10. The laundry apparatus of claim 1, wherein the bearing housing comprises, a third flange in ring shape arranged in an outer area with respect to a radial direction of the second flange;

a plurality of third connection ribs connecting an outer circumferential surface of the second flange to the third flange;

a plurality of third insertion holes disposed between the third connection ribs, wherein a longitudinal axis of each of the plurality of third connection ribs is perpendicular to the circumferential surface of the housing body.

11. The laundry apparatus of claim 1, further comprising a stator coupling portion disposed in the rear wall of the tub and configured to couple to the stator, and wherein the rotor comprises:

a rotor housing fixed to the shaft; and a permanent magnet fixed to the rotor housing and disposed in an outer area with respect to a radial direction of the stator.

* * * * *